United States Patent [19]

Maassen et al.

[11] Patent Number: 4,884,699

[45] Date of Patent: Dec. 5, 1989

[54] WINDING MACHINE

[75] Inventors: Wilhelm Maassen; Gregor Gebald; Ulrich Thomas, all of Mönchengladbach, Fed. Rep. of Germany

[73] Assignee: W. Schlafhorst & Co., Mönchengladbach, Fed. Rep. of Germany

[21] Appl. No.: 248,332

[22] Filed: Sep. 20, 1988

Related U.S. Application Data

[63] Continuation of Ser. No. 5,336, Jan. 15, 1987, abandoned, which is a continuation of Ser. No. 599,173, Apr. 11, 1984, abandoned.

[30] Foreign Application Priority Data

Apr. 14, 1983 [DE] Fed. Rep. of Germany ..... 3313468

[51] Int. Cl.[4] ..... B07C 5/34; B65H 54/02

[52] U.S. Cl. ..... 209/587; 57/281; 209/920; 209/927; 242/35.5 A

[58] Field of Search ..... 209/927, 587, 644, 920, 209/932; 57/281; 242/35.5 A; 198/391, 757

[56] References Cited

U.S. PATENT DOCUMENTS

| | | | |
|---|---|---|---|
| RE. 26,916 | 6/1970 | Austin | 209/587 |
| 3,045,820 | 7/1962 | Philbin et al. | 209/629 X |
| 3,091,332 | 5/1963 | Parker | 209/557 X |
| 3,195,298 | 7/1965 | Furst | 209/927 X |
| 3,207,307 | 9/1965 | Means | 209/560 |
| 3,305,087 | 2/1967 | Lucker | 209/927 X |
| 3,334,740 | 8/1967 | McCollough et al. | 209/927 X |
| 3,378,139 | 4/1968 | Perry | 209/632 |
| 3,394,806 | 7/1968 | Vaillette | 209/655 X |
| 3,399,756 | 9/1968 | Klapes | 198/757 X |
| 3,606,012 | 9/1971 | Brouwer | 209/927 X |
| 3,608,293 | 9/1971 | Brouwer | 57/281 |
| 3,913,743 | 10/1975 | Nelson | 209/927 X |
| 4,181,228 | 1/1980 | Hashimoto et al. | 209/552 |
| 4,333,558 | 6/1982 | Nonaka et al. | 198/391 |
| 4,462,508 | 7/1984 | Grafius | 209/920 X |
| 4,506,572 | 3/1985 | Kupper | 83/909 X |
| 4,535,893 | 8/1985 | Buhren | 209/927 X |
| 4,570,865 | 2/1986 | Kawarabashi et al. | 209/927 X |

*Primary Examiner*—Dennis H. Pedder
*Assistant Examiner*—Edward M. Wacyra
*Attorney, Agent, or Firm*—Herbert L. Lerner; Laurence A. Greenberg

[57] ABSTRACT

A winding machine having a transporting device for directly supplying to the winding machine bobbins or spun coils from a spinning machine, and for returning ejected tube sleeves to the spinning machine, includes a device for comparing and adjusting a flow of the tube sleeves returned from the winding machine to a requirement for tube sleeves by the spinning machine, the transporting device being connected with a device for holding back ejected tube sleeves which are at least partly wound.

3 Claims, 6 Drawing Sheets

FIG. 2
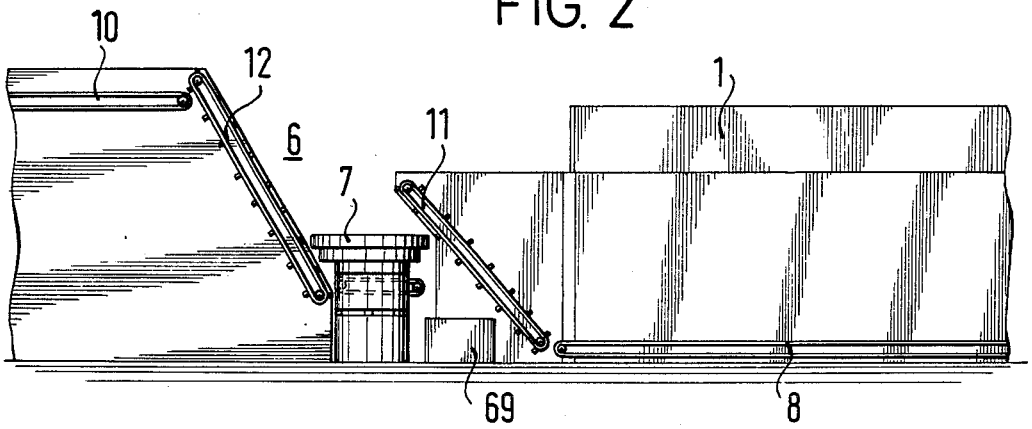
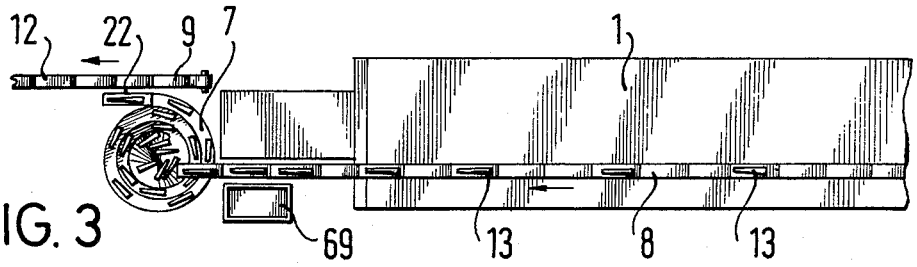
FIG. 3

FIG. 8
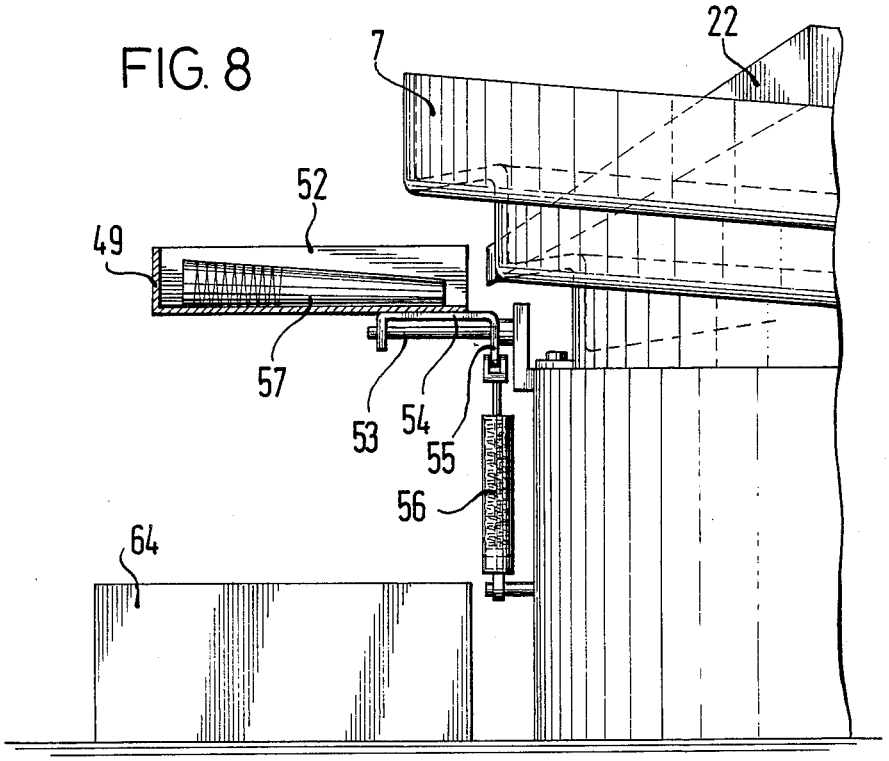
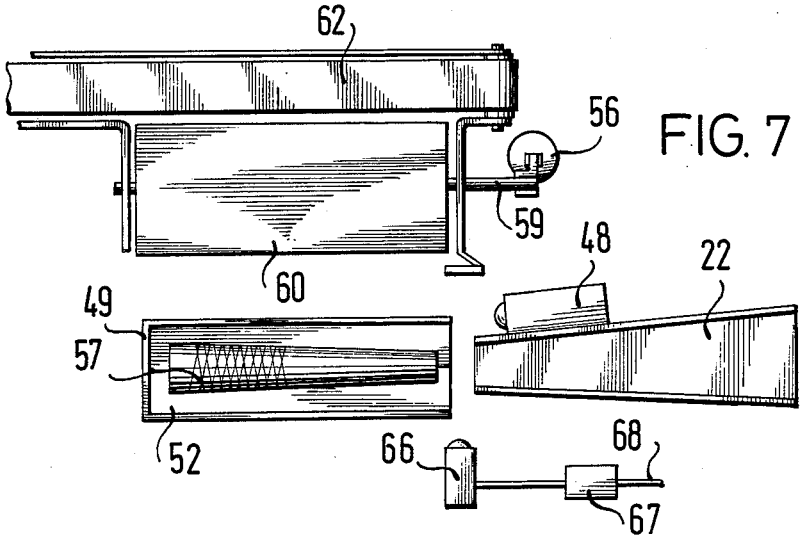
FIG. 7

WINDING MACHINE

This application is a continuation of application Ser. No. 005,336, filed Jan. 15, 1987, now abandoned, which is a continuation of application Ser. No. 599,173, filed Apr. 11, 1984, now abandoned.

The invention relates to a winding machine comprising transport machinery which directly supplies it with bobbins or spun coils from a spinning machine, and re-conducts the tube sleeves ejected by the winding machine back to the spinning machine. The tube sleeves are circulated in a practically closed loop, so that neither different tube sleeves can be supplied to the spinning machine, nor spools from different batches can be conducted to the winding machine.

From DE-AS No. 12 78 308 it is known to arrange in the transport machinery which returns the ejected tube sleeves to the spinning machine, a sorting device for selecting tube sleeves having still a useable minimum amount of winding left. In this way still useable spun coils are separated from the ejected tube sleeves, and thereafter conducted to another device which locates the beginning of the thread in the spun coil, and then automatically returns the coil to the winding machine. Those tube sleeves having only windings left too small to be utilized are together with the empty tube sleeves conducted to another device which removes the leftover windings still on the bobbin. Before removing the leftover windings, another separating operation can be performed with the objective to conduct the empty tube sleeves directly to the spinning machine.

The known winding machine can be operated completely automatically, however, the arrangement is technically very complicated, and requires a lot of space.

Modern winding machines are so constructed that the spun bobbins are completely unwound most of the time, and very rarely windings are left on the tube sleeves. For example, modern thread joining methods such as thread splicing have contributed to this improvement of winding operations. For this reason, from an economical point of view it is not justified to equip a winding machine with very costly additional devices which are only occasionally used.

Another disadvantage at known winding machines is the fact that the irregular return of tubes from the winding machine is not in step with the tube sleeve requirement of the spinning machine. As a result, idle waiting times of both machines do occur.

The invention has the basic objective to guarantee with simple provisions the reliable, orderly operation of the two interdependent textile machines.

This objective is achieved according to the invention by the features that the winding machine is provided with a device to regulate and adjust the flow of tube sleeves returning from the winding machine according to the requirement for tube sleeves of the spinning machine, and that this transporting machinery is combined with a device for holding back such tube sleeves which still carry windings or are partially wound.

The device for regulating and adjusting the flow of material represents a buffer, which can accept tube sleeves arriving in rapid succession from the winding machine, and transfer them to the spinning machine according to the requirement for tube sleeves of the latter. In any case, the spinning machine determines the transfer rate. Several spinning machines can be assigned to a single winding machine. The capability of the winding machine is chosen so that it can rewind the maximum output of spun coils or bobbins from the spinning machine in continuous operation. A circulation of tube sleeves is established containing a predetermined basic supply of tube sleeves. The number of circulating tube sleeves is greater than the combined sum of tube sleeves in the spinning machine and in the winding machine. For practical purposes the device for regulating and adjusting the material flow is provided with a tube sleeve storage space disposed in the path of the material flow. In this storage space a basic quantity of tube sleeves is loaded, which is at least great enough to make up in a defined time interval the number of tube sleeves which are held back because some winding is left on them. The percentage of still wound or partially wound tube sleeves, compared to the returned empty tube sleeves, is very small. For this reason it is sufficient only to hold back the wound or partially wound tube sleeves. However, it is also possible to separate automatically tube sleeves which were held back, but this operation is not absolutly necessary. Another possibility is to remove after visual inspection manually the tube sleeves which were held back.

There are several ways to hold back partially wound or wound tube sleeves. According to a further development of the invention, the device for holding back wound or partially wound tube sleeves is arranged in the path of the material downstream from the device which regulates and adjusts the material flow. It is practical if the device is provided with an electro-optical monitor which tests for the presence of windings, and is arranged near a testing station which alternatingly accepts and transfers a tube sleeve, and has an activating connection to a controllable tube sleeve separator which is disposed downstream from the test station, and deflects wound or partially wound tube sleeves from the path of the material. In this case the wound or partially wound tube sleeves are actually separated directly, and the device accomplishing this task is timed to the machine rate. The timing can be chosen so that it corresponds to the tube sleeve requirement of the spinning machine, or so that the timing is controlled by the tube sleeve requirement of the spinning machine, or is controlled by the machine cycle of the spinning machine.

However, the holding back of wound or partially wound tube sleeves can also be accomplished by accumulation, according to a further development of the invention. For this purpose the device for regulating and adjusting the material flow has an accumulation device for increasing the tube sleeve supply with the wound and/or partially wound tube sleeves. In practice the tube sleeve supply is positioned in a place where it can be visually monitored. The accumulated still wound or partially wound tube sleeves can be removed manually after visual inspection.

In a further development of the invention, the device for regulating and adjusting the material flow is made in the form of a circular loose part conveyor which is provided with a central storage space for the tube sleeves. The winding machine delivers the tube sleeves into the central tube sleeve storage space. The tube sleeves are treated like any other loose material. The circular conveyor for such material serves for the uniform removal and transfer of the tube sleeves. The central tube sleeve storage space acts as a buffer storage at the same time. In practice the circular loose part conveyor is made in the form of a vibratory conveyor. It is provided with a slide surface which rises in the form of a spatial spiral from the central tube sleeve storage space to the upper edge, whereby this slide surface is also somewhat inclined from the horizontal plane toward the outside, and has a border wall at the outside.

According to a further development of the invention, the device for holding back wound or partially wound tube sleeves, and the accumulation device for accumulating wound or partially wound tube sleeves in the tube sleeve storage space are combined to function as a tube sleeve control device. In practice the tube sleeve control device consists of an adjustable wall section arranged in the border wall of the slide surface of the vibratory conveyor, and at this place this wall section determines the width of the slide surface. If the width of the tube sleeve exceeds a predetermined dimension due to leftover windings, the tube sleeve is rejected and falls back into the tube sleeve storage space. For the case that there are only a few winding turns left, or a few thread layers only, an electro-optical monitor is provided, and a tube sleeve rejecting means, which is controlled by this monitor, and rejects wound or partially wound tube sleeves by deflecting them from the slide surface into the tube sleeve storage space. The technical complexity of this arrangement is somewhat greater, but by this feature also tube sleeves are rejected which carry only a few windings. The tube sleeve rejecting device may also comprise a blower. However, the tube sleeve rejecting device could also be constructed as a controllable mechanical tube ejector. Compressed air is not available in all cases, and there a mechanical device may be easier to produce and to operate.

Typical embodiments of the invention used as examples are illustrated in the drawings. The invention will be further described and explained with the aid of these typical embodiments.

FIG. 2 is a schematic view of a machine arrangement for regulating and adjusting the flow of material.

FIG. 3 is a schematic top view of the arrangement in FIG. 2.

FIG. 7 is a top view of the device according to FIG. 6.

FIG. 8 is a side view of the device according to FIG. 6.

Figure 1:
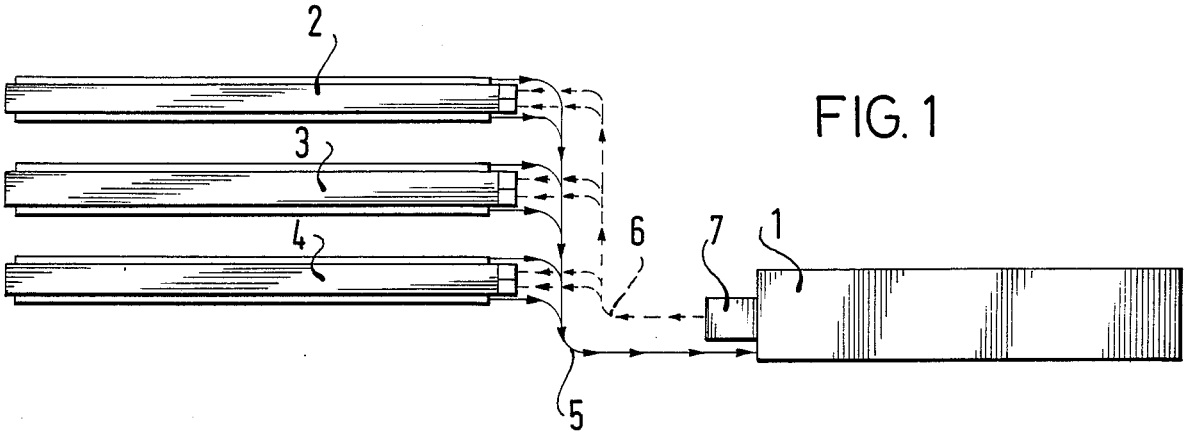
FIG. 1 shows schematically the combination of a single winding machine with three spinning machines.

According to FIG. 1 three spinning machines 2, 3 and 4 are assigned to one winding machine 1. A transporting device 5 conducts the spun coils made in the spinning machines to the winding machine 1. In said winding machine the spun coils are rewound to form cross-wound cheeses. The empty tube sleeves are moved back in direction of the arrows to the spinning machines 2 to 4 by a transport device 6. The winding machine 1 has a provision 7 to regulate and adjust the material flow of the tube sleeve return apparatus of the winding machine 1 dependent on the quantity of tube sleeves required for the operation of the spinning machines 2 to 4.

FIGS. 2 and 3 indicate that the transport device 6 comprises conveyor belts 8, 9, 10, and elevators 11, 12 for the tube-sleeves 13.

FIGS. 2 to 5 show that the device 7 for regulating and adjusting the material flow is constructed as a loose material circular conveyor, in particular a circular vibratory conveyor. Said vibratory conveyor 7 has a central tube sleeve-storage space 14 with a cone-shaped bottom 15, shown in FIG. 5. The diameter of the tube sleeve storage space 14 depends on the size of the tube sleeves, and the expected quantity of tube sleeves which have to be stored. The tube sleeve storage space is shown in the drawings out of proportion small to save space.

Tube sleeves which are placed on the bottom 15 of the central tube sleeve storage space 14 roll and slide toward the periphery, as soon as the vibrator 16 is started to vibrate the vibratory conveyor 7 in the directions of the curved double arrow 17. Thereby the motion in the direction of arrow 18 is somewhat faster than the motion in the opposite direction. The result is that the tube sleeves located at the periphery of the bottom 15 travel upward on a slide-surface 19. This slide surface 19 rises in a spatial spiral from the bottom 15 of the central tube sleeve storage space 14 to its edge 20. Beside the inclination of the slide surface 19 which follows the shape of the spiral, the slide surface 19 is also inclined to the outside somewhat away from the horizontal plane, and it is also provided with a border wall 21 at its outside, which also has the form of a spatial spiral.

The tube sleeves which are to be transported back are deposited onto the conveyor belt 8 at the winding machine 1, from there they get onto the elevator 11 which drops them into the tube-sleeve storage space 14 of the vibratory conveyor 7. Thereafter, the tube sleeves move from the vibratory conveyor 7 over a slide 22 onto the conveyor belt 9, and from there onto the elevator 12 which transfers the tube sleeves onto the conveyor belt 10.

Figure 4:
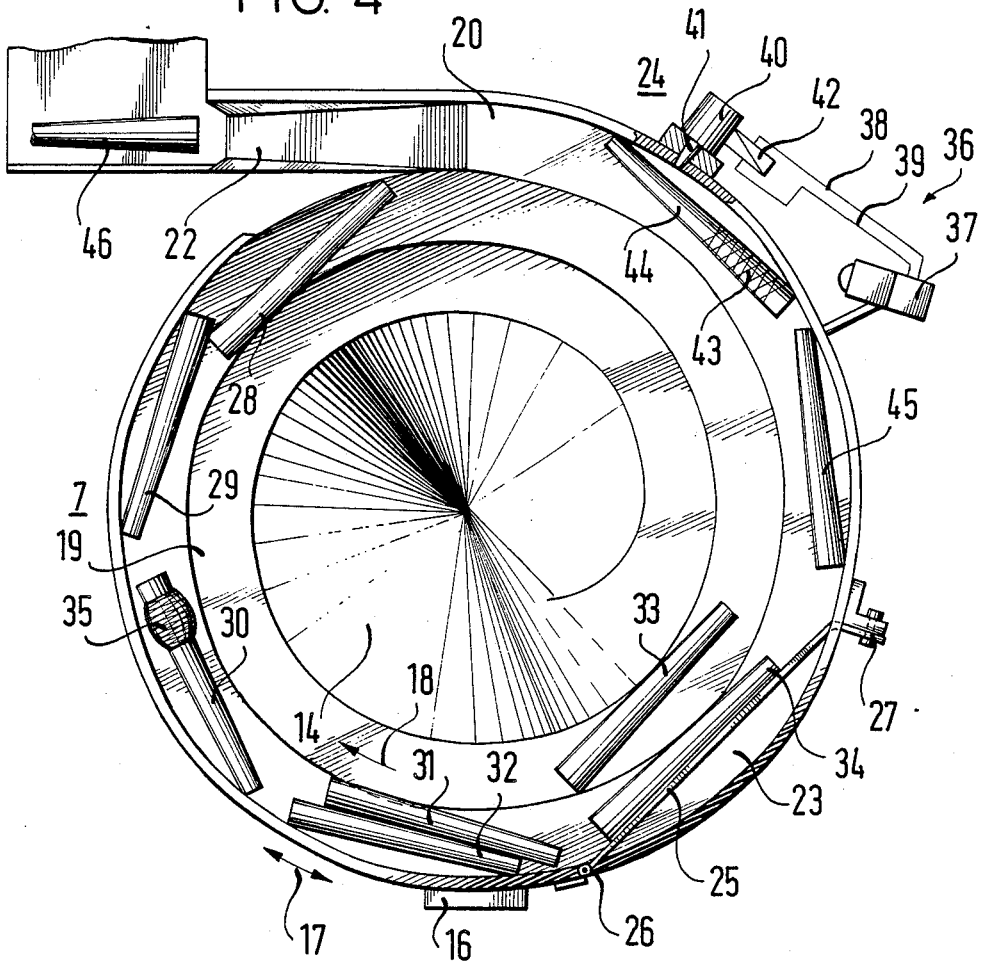
FIG. 4 is a top view of the vibratory conveyor of the machine arrangement in FIG. 2.
Figure 5:
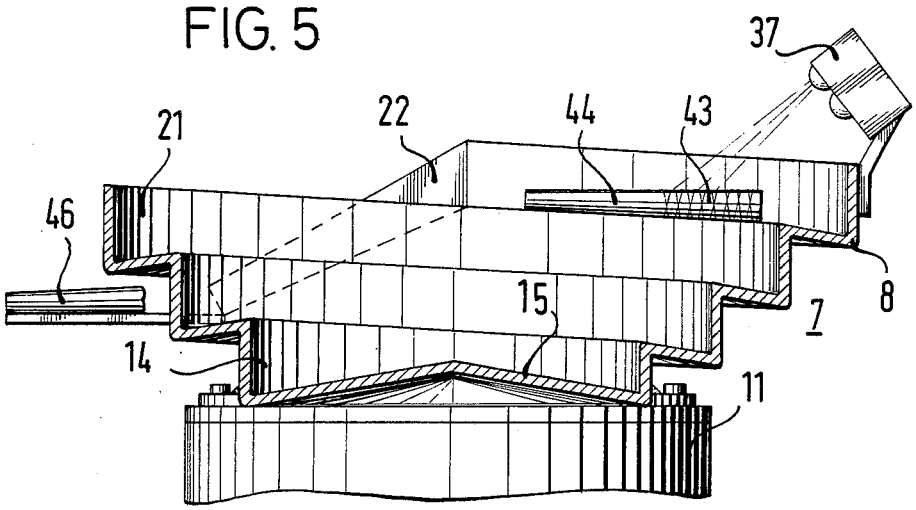
FIG. 5 is a section through the vibratory conveyor according to FIG. 4.

FIG. 4 shows that the device 7 comprises one accumulation device as a whole designated with the reference number 23 for accumulating and storing tube sleeves with windings, and another accumulation device, as a whole designated with 24, for accumulating and storing partially wound tube sleeves.

The accumulation device 23 serves also as a device for holding back tube sleeves with windings on them. Both devices form a tube sleeve control arrangement which consists of an adjustable wall section 25 which is arranged in the border wall 21 of the slide surface 19, and determines the width of the slide surface 19 at this section. Said wall section 25 is hingeably supported by a hinge 26, and can be adjusted and secured by an adjustment screw 27.

FIG. 4 shows the tube sleeves 28 to 34 positioned on the slide surface 19. The tube sleeve 34 is just passing the wall section 25. The tube sleeve adjacent to it was rejected and is falling back into the sleeve storage space 14. The tube sleeves 31 and 32 are transported upward adjacent to each other, and it can be predicted that tube sleeve 31 will be also rejected when the tube sleeve 32 passes the wall section 25. Tube sleeve 30 carries a partial winding 35 with a larger diameter. This tube sleeve will be rejected also by the wall section 25 later, and will fall back into the tube sleeve storage space 14. Tube sleeves 28 and 29 will probably separate, and position themselves one behind the other.

As shown in FIG. 4, the vibrating conveyor 7 is provided with an additional tube sleeve control device 36. This tube sleeve control device 36 consists of a combination of the accumulation device 24 with a device 37 for holding back tube sleeves with a partial winding . The device 37 is an electro-optical monitor which is connected with the accumulation device 24 by the activating connections 38, 39. The accumulation device 24 consists of a tube sleeve rejector 40 and a blower 41 which is controlled by an electro-magnetic actuator 42.

FIG. 4 indicates that the thread layers 43 on the tube sleeve 44 are so thin that the tube sleeve has passed the control device 25 without being rejected. However, the electro-optical monitor 37 has just sensed and recognized the thread layers 43, causing the electro-magnetic actuator 42 to give an activating pulse to the blower 41. As the air jet is discharged by the blower 41 the tube sleeve is pushed off the slide surface 19, and falls back into the tube sleeve storage space 14. Because tube sleeves with windings or with partial windings accumulate in the tube sleeve storage space 14, they can be easily recognized in a checking operation, and then be removed from the tube sleeve storage space. Tube sleeve 45, positioned behind tube sleeve 44 is empty, and will easily pass the tube sleeve control device 36. Tube sleeve 46 is also empty, and is just sliding onto the conveyor belt 9.

Figure 6:
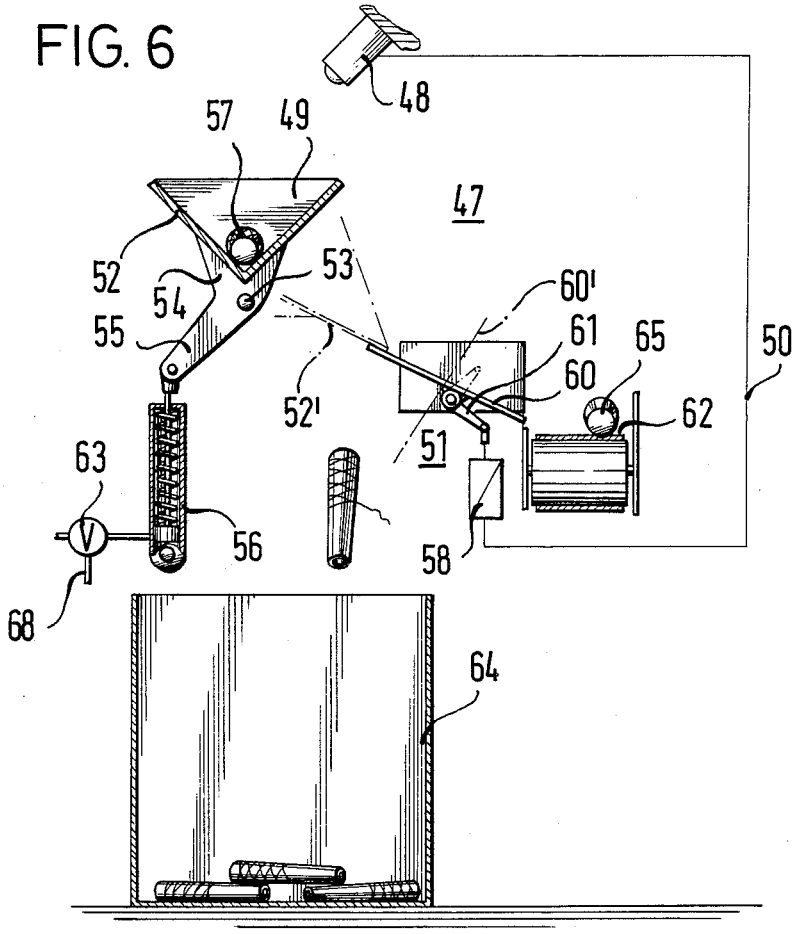
FIG. 6 shows schematically a device for holding back tube sleeves which are wound or partially wound.

At the alternate embodiment according to FIGS. 6 to 8, the device 7 which serves to regulate and adjust the material flow to the requirement for tube sleeves of the spinning machine is not provided by itself with means to hold back tube sleeves with windings or partially wound tube sleeves. At this embodiment a device 47 for holding back tube sleeves with windings or with partial windings is provided, following the arrangement for regulating and adjusting the material flow. Especially FIG. 6 shows that the device 47 includes an electro-optical device 48 which tests for the presence of windings. Said winding tester 48 is arranged at a testing station 49. The device 48 which tests for the presence of windings, has an activating connection 50 to a tube sleeve separator 51, which is disposed downstream from the testing station 49.

FIG. 7 shows that the device 48 which tests for the presence of windings, is fastened to the slide 22. The testing station 49 comprises a trough 52 which can hinge around a horizontal axis 53. For this function the trough 52 is carried by a holder bracket 54 with a lever 55. This lever 55 articulates with a pneumatic work cylinder 56.

Drawings 6 to 8 show a partially wound tube sleeve 57 in the trough 52. The device 48 has detected the partial windings, so that the electro-magnetic actuator 58 of the tube sleeve separator 51 is activated by the connection 50. The tube sleeve separator 51 has a trap-door 60 which can hinge around the horizontal axis 59; this trap-door is now moved to position 60'. For this function the trap-door 60 is provided with a lever 61 which articulates with the electro-magnetic actuator 58. When the trap-door 60 is in position 60', the trough 52 swings into position 52' after the valve 63 has opened, and thereby the partially wound tube sleeve 57 rolls from the trough 52, is deflected downward by trap-door 60, and falls into container 64, as shown in FIG. 6.

In the case that the detecting device 48 does not detect the windings, the trap-door 60 remains in its rest position, and the empty tube sleeve, for example, tube sleeve 65 slides along the trap-door 60 onto the conveyor belt 62.

FIG. 7 indicates that a reflection light gate 66 is arranged before the end of the slide 22. This reflection light gate 66 serves to control the timing. It reacts when a tube sleeve which slides to the test station 49 obstructs the light path. The reflection light gate in conjunction with a time delay means can initiate the next operational cycle of the trough 52. For this purpose the reflection light gate 66 has a functional connection 68 to the valve 63 comprising a delaying means 67.

The invention is not limited to the illustrated and described typical embodiments used as examples.

As a rule, the output of spools of the winding machine is greater than the maximum spool output of the attached spinning machines. However, it is possible that the spinning operation has to be stopped, if the winding machine is temporarily disabled or forced to operate more slowly. This is the case with bad yarns, if many breaks must be repaired during the re-winding operation. At such operational problems, the invention with its bufferstorage of empty tube sleeves makes it possible to continue the operation of the spinning machines. After the problem is removed the winding machine is capable to make-up the accumulated workload in a short time.

For supplementing the supply of tube sleeves of the device 7 during the described disturbances, a container 69 filled with tube sleeves can be kept ready, and if emptied can also hold finished spun bobbins temporarily.

In an alternate version, the supply of tube sleeves for the device 7 can also be monitored electro-optically, and be replenished automatically when less than a minimum quantity of tube sleeves is available.

We claim:

1. Winding machine assembly comprising transporting means for directly supplying to a winding machine of the assembly bobbins or spun coils from a spinning machine and for returning ejected tube sleeves to the spinning machine in a practically closed loop, and a device for comparing and adjusting a flow of the tube sleeves returned from the winding machine to a requirement for tube sleeves by the spinning machine, said transporting means being connected with a device for holding back ejected tube sleeves which are at least partly wound, said device for holding back the at least partly wound tube sleeves being provided with a device for testing for a presence of windings on the respective tube sleeves, said testing device being arranged near a testing station which alternatingly accepts and transfers a tube sleeve, and being operatively connected to a controllable tube sleeve gate disposed downstream from said test station and deflecting at least partly wound tube sleeves from the path of the tube sleeve flow, said device for comparing and adjusting the tube sleeve flow having an accumulation device for increasing the tube sleeve supply with at least partly wound tube sleeves, said device for holding back the at least partly wound tube sleeves being arranged in the path of the flow of the tube sleeves downstream from said device for comparing and adjusting the flow of the tube sleeves.

2. Winding machine assembly according to claim 1, wherein said device for comparing and adjusting the flow of the tube sleeves is provided with a stationary tube sleeve storage space disposed in a path of the flow of the tube sleeves.

3. Winding machine assembly according to claim 1 wherein said transporting means comprise a first transporting device for directly supplying the bobbins or spun coils from the spinning machine to the winding machine, and a second transporting device for returning ejected tube sleeves to the spinning machine in said practically closed loop.

* * * * *